US009957761B2

(12) United States Patent
Gorrara et al.

(10) Patent No.: US 9,957,761 B2
(45) Date of Patent: May 1, 2018

(54) DOWNHOLE DRILLING DEVICE

(71) Applicant: NABORS LUX FINANCE 2 SARL, Luxembourg (LU)

(72) Inventors: Andrew Gorrara, Algard (NO); Tore Grenasberg, Algard (NO)

(73) Assignee: NABORS LUX 2 SARL, Luxembourg (LU)

( * ) Notice: Subject to any disclaimer, the term of this patent is extended or adjusted under 35 U.S.C. 154(b) by 215 days.

(21) Appl. No.: 14/837,824

(22) Filed: Aug. 27, 2015

(65) Prior Publication Data

US 2016/0060975 A1 Mar. 3, 2016

(30) Foreign Application Priority Data

Aug. 28, 2014 (NO) ..... 20141049

(51) Int. Cl.
*E21B 17/10* (2006.01)
*E21B 4/04* (2006.01)
*E21B 7/06* (2006.01)

(52) U.S. Cl.
CPC ..... *E21B 17/1078* (2013.01); *E21B 4/04* (2013.01); *E21B 7/062* (2013.01)

(58) Field of Classification Search
CPC combination set(s) only.
See application file for complete search history.

(56) References Cited

U.S. PATENT DOCUMENTS 6,641,434 B2 * 11/2003 Boyle ..... E21B 17/028 166/242.6
6,670,880 B1 * 12/2003 Hall ..... E21B 17/028 336/132
8,567,529 B2 * 10/2013 Williams ..... E21B 3/02 175/103
2001/0042643 A1 11/2001 Krueger et al.
2004/0164838 A1 8/2004 Hall et al.
2007/0194948 A1 8/2007 Hall et al.
2010/0186944 A1 7/2010 Hall et al.
2014/0102807 A1 4/2014 Zhao et al.

FOREIGN PATENT DOCUMENTS

EP 1174582 A2 1/2002
WO 2008156375 A1 12/2008
WO 2012152914 A2 11/2012

OTHER PUBLICATIONS

Office Action issued in Norwegian Patent Application No. 20141049, dated Mar. 25, 2015 and English translation therof (5 pages).

* cited by examiner

*Primary Examiner* — Sean D Andrish
(74) *Attorney, Agent, or Firm* — Adolph Locklar

(57) ABSTRACT

A downhole drilling device (1) may include a drill bit rotatable via a drill string (11); a guiding device (4) provided between said drill bit and said drill string (11), said guiding device (4) being connected to and operable independently from said drill string (11); and a power source (5) for powering said guiding device (4). The downhole drilling device (1) may include an inductive coupler (6, 6') having a primary side (61) and a secondary side (63), said inductive coupler (6, 6') being adapted to transfer power from said power source (5), connected to the primary side (61) of said inductive coupler (6, 6'), to said guiding device (4), connected to the secondary side (63) of said inductive coupler (6, 6').

19 Claims, 4 Drawing Sheets

DOWNHOLE DRILLING DEVICE

CROSS-REFERENCE TO RELATED APPLICATIONS

This application is a nonprovisional application which claims priority from Norwegian Patent application number 20141049, filed Aug. 28, 2014.

TECHNICAL FIELD/FIELD OF THE DISCLOSURE

The present invention relates to a downhole drilling device. More particularly the invention relates to a device for downhole drilling comprising a drill bit rotatable via a drill string, a guiding device provided between said drill bit and said drill string, said guiding device being connected to and operable independently from said drill string, and a power source for powering said guiding device.

BACKGROUND OF THE DISCLOSURE

In downhole drilling devices according to the prior art, power for driving downhole electric components has normally been supplied via wires from the surface or battery packs included in the downhole device. Power may be required for guiding the drill bit in the well while drilling, so as to be able to drill deviated wells. Power transfer via long wires is undesirable because it limits the design options for the drilling device as long power-transferring wires cannot connect to both rotating and non-rotating parts of the drilling device. Power is also lost in the wire during transfer. Power supplied from included battery packs limits the lifetime between runs to pull out and replace the battery packs, and may significantly increase the length and running cost of the device.

Downhole power sources, such as mud generators, have been used for downhole power generation, and mud generators offer the advantage of downhole sustainable power supply. However, such mud generators are typically provided in the hollow rotating drill string, rotating together with the drill string. Existing power transfer devices generally rely on mechanical contact devices, such as slip-ring devices, which are prone to damage, wear and high contact resistance and which become less efficient over time. The consequence of this is high power losses and temperature increases. No robust solution exists for transferring power from the continuously rotating drill string to nonrotating parts of the bottom hole assembly. On the other hand, various forms of accumulators, such as batteries, could be provided on non-rotating parts, but the power from an accumulator is limited as is the space for placing such accumulators downhole.

SUMMARY

More specifically, the invention relates to a downhole drilling device. The downhole drilling device may include a drill bit rotatable via a drill string; a guiding device provided between said drill bit and said drill string, said guiding device being connected to and operable independently from said drill string; and a power source for powering said guiding device. The downhole drilling device may further include an inductive coupler having a primary side and a secondary side, said inductive coupler being adapted to transfer power from said power source, connected to the primary side of said inductive coupler, to said guiding device, connected to the secondary side of said inductive coupler. It will thus be possible to transfer power across rotating connections of the drill string, which may significantly simplify drilling device design.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
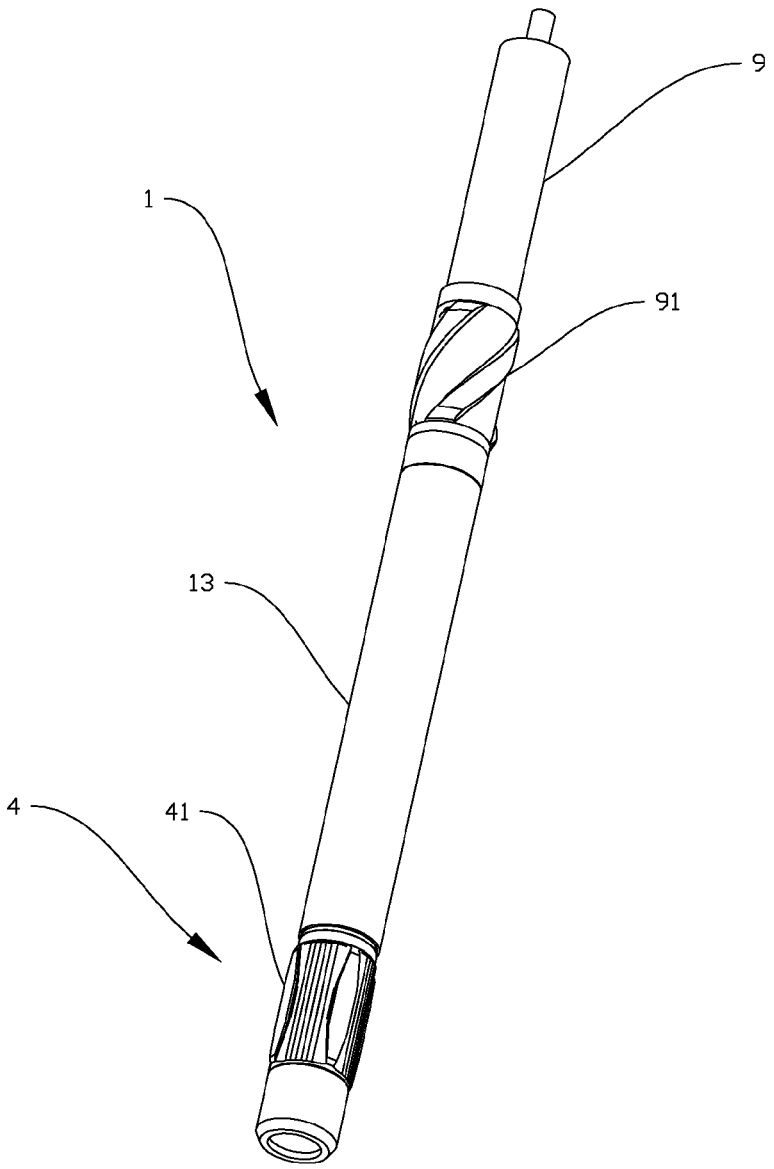
FIG. 1 shows, in a perspective view, a downhole drilling device according to the present disclosure.

The present invention may be used for the transfer of power and/or data between two parts of any drilling tool, where one part is rotating at a different speed relative to the other part. In the following the drilling tool will be exemplified by a directional drilling device, but the invention as such is not limited to a directional drilling device.

In one embodiment the power source may be a downhole power source, such as a mud turbine generator. The drilling device may thus not require transfer of electrical power from the surface, which may further simplify the design of the drilling device. Also a mud turbine generator will typically be installed in the mud path inside the drill string, thus not taking up unnecessarily much space.

In one embodiment said guiding device may be radially displaceable relative to said drill string. The drilling device may thus be suitable for guiding the drill bit by means of "push the bit" technology, wherein the guiding device is radially displaced in the borehole, e.g. towards a liner or the formation itself, so as to push the bit in the opposite direction of the guiding device and thus alter the direction of drilling. Examples of guiding devices wherein eccentric sleeves are used to control the amount and the direction of the displacement of the guiding devices, are disclosed in patent applications WO 2008156375 and WO 2012152914 to which reference is made for an in-depth description of a possible functionality of such guiding devices.

In one embodiment said guiding device may include a first electric actuator for controlling the radial displacement of said guiding device relative to said drill string; and a second electric actuator for controlling the direction of the radial displacement of said guiding device relative to said drill string. This may be done by using said first and second electric actuators for controlling eccentric sleeves as described in the above-reference patent applications. The directional guiding of said drilling device may thus be fully electric, and if combined with the above-mentioned downhole energy source, the drilling device may be fully self-contained with respect to power supply for the guiding device and for any measurement while drilling (MWD) logging tools. The rotation of the drill string itself may be powered and/or executed from the surface, and will be independent of the powering of the guiding device and the other downhole electronics devices.

In one embodiment the downhole power source may be connected to the primary side of said inductive coupler via a rectifier and a power inverter. This may be beneficial as electronics on the primary side of said inductive coupler may require DC input, and thus be powered from the same power source. The rectified signal must then subsequently be inverted or chopped before fed onto the windings of the primary side of said inductive coupler.

In an alternative embodiment an alternating current power source with one or more phases may be connected directly to the primary side of said inductive coupler consisting of one or more coil pairs, which may be beneficial for avoiding switching losses.

In one embodiment said inductive coupler may further be adapted for bi-directional data transfer. This way it will be possible both to communicate instructions to said guiding device and other electronics over the rotating connection, and at the same time communicate from the bottom hole assembly (BHA) to the surface, both information about the guiding device and other loggings performed while drilling, as will be known to a person skilled in the art.

In one embodiment one or more coils for bi-directional data transfer may be isolated from one or more coils for power transfer, for instance by providing one or more coils for bi-directional data transfer without magnetic means, such as magnetic cores, of coils for power transfer. This may increase the signal to noise ratio of the data signals. Coils for data transfer may not need to be provided with magnetic means. Factors that may influence the use of magnetic means are isolation of data signals from power signals, frequency used for data transfer, desired bandwidth of communication signals.

In one embodiment said inductive coupler, on its primary side, may be adapted to produce an analogue or digital feedback signal modulated on a transmit coil for coupling a signal proportional to an output voltage in a power coil on the secondary side to the primary side. The voltage feedback may be beneficial for controlling the voltage output on the secondary side, potentially in a closed loop system by modulating the drive on the primary side. In this way it will be possible to keep the voltage on the secondary side within a predefined limit. The modulation may take various forms but will preferably be a pulse width modulation of the primary side.

In one embodiment the output voltage may be controlled by prior knowledge of the input voltage and the system load using modulation of the primary drive signal.

In one embodiment said inductive coupler may include magnetic means, such as cores, formed with anomalies for the determination of relative position and speed of the primary and secondary sides. The anomalies, which may be cavities, will constitute magnetic signatures that may be measured so as to give full control over the relative position, direction and speed of the drilling device according to the invention. For example if there are unevenly spaced anomalies in the magnetic means on the secondary side, a pulse will be created every time the anomaly passes a reference point in the magnetic means on the primary side. The pulses and the time between pulses can be logged, thus enabling the computation of both the direction of rotation and the speed of rotation by simple arithmetic calculations.

In one embodiment one or more coils of said inductive coupler may include U-shaped magnetic means. It has been found, through experiments and modelling, that U-shaped magnetic means may be more efficient than magnetic means with other shapes, such as E-shaped magnetic means which have traditionally been used. In one embodiment at least a part of said inductive coupler may be potted in a resin-based material. The resin-based material may mechanically protect the magnetic means and associated windings by sealing and making it suitable for downhole operations in high temperatures and pressures. The resin-based compound may further be infused with a magnetically permeable material in order to improve/tailor the coupling efficiency between said primary and secondary sides.

In one embodiment a gap between the primary side and the secondary side of said inductive coupler may be less than 1 millimeter and preferably less than 0.5 millimeters. With a too large gap between the primary and secondary side, a lot of efficiency is lost in the transfer. Gaps of less than 0.5 millimeters have been shown to enable more than 90% power transfer. Reasonable, useful efficiencies are also obtained for gaps between 0.5 millimeters and 1 millimeter, whereas gaps up to 1 centimeter has been shown to also provide some power transfer.

In one embodiment the primary side and the secondary side of said inductive coupler may be arranged in a radial configuration. In an alternative embodiment the primary side and the secondary side of said inductive coupler may be arranged in an axial configuration.

There is also described the use of an inductive coupler for transferring power for the guiding of a downhole drilling device. The is also described the use of an inductive coupler for transferring power and data between two parts of a downhole drilling device, where one part is rotating at a different speed relative to the other part.

Figure 2:
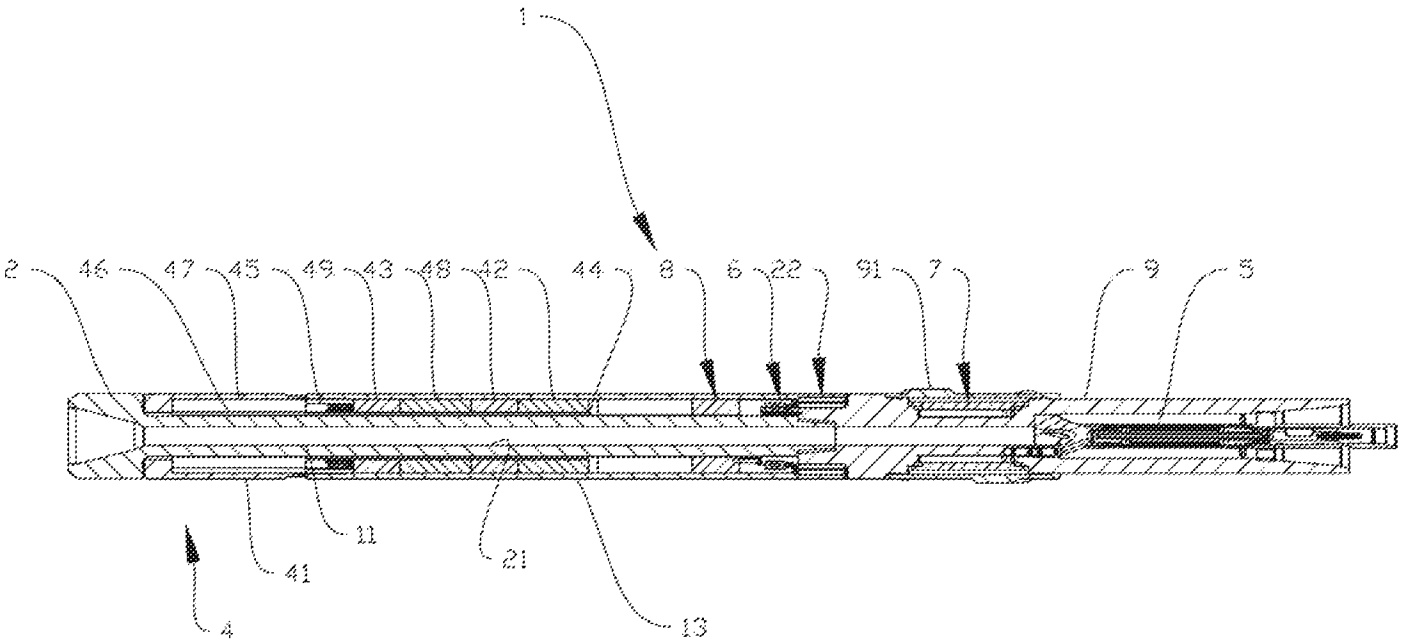
FIG. 2 shows, in a cross-section, the downhole drilling device from FIG. 1.
Figure 3:
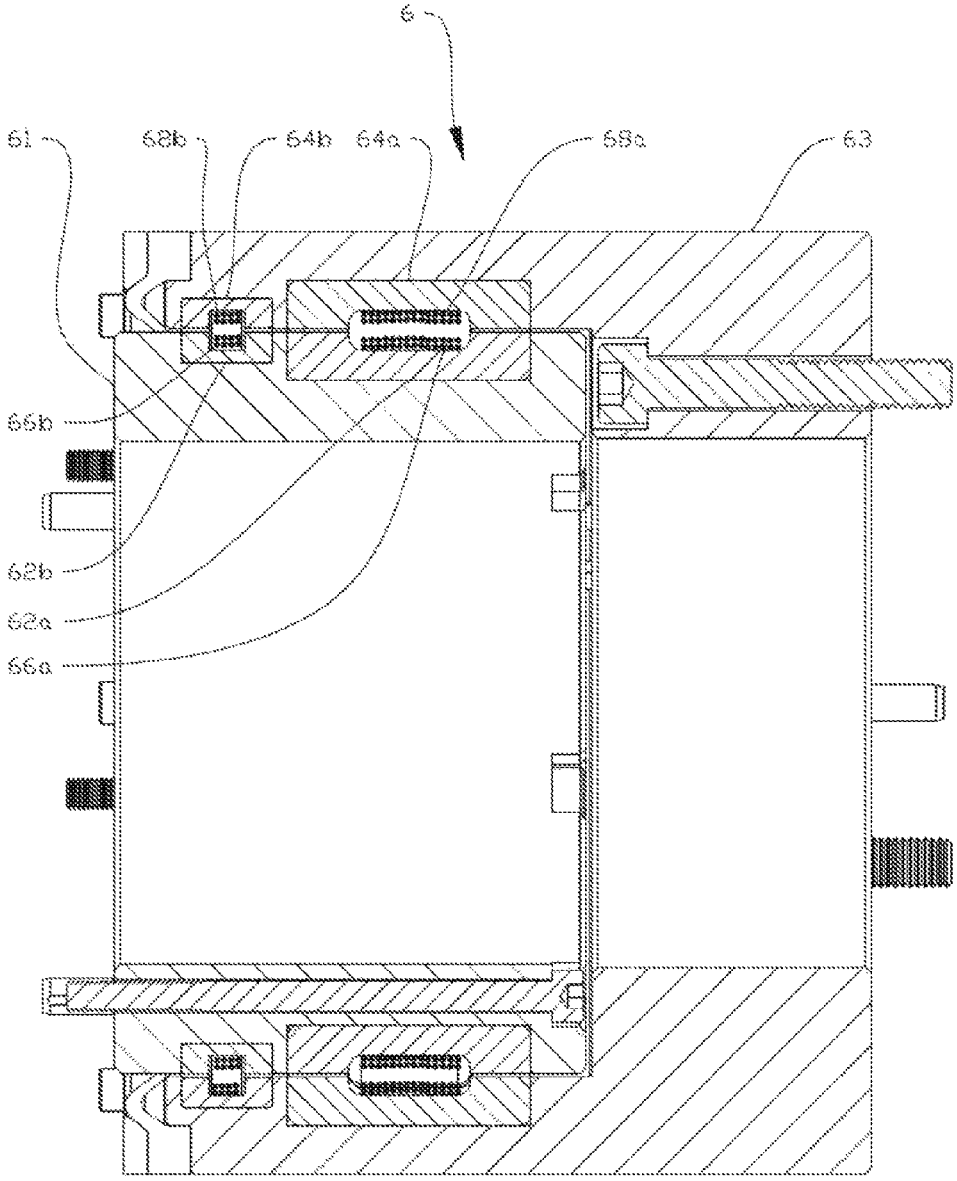
FIG. 3 shows, in an enlarged view, a detail from FIG. 2.
Figure 4:
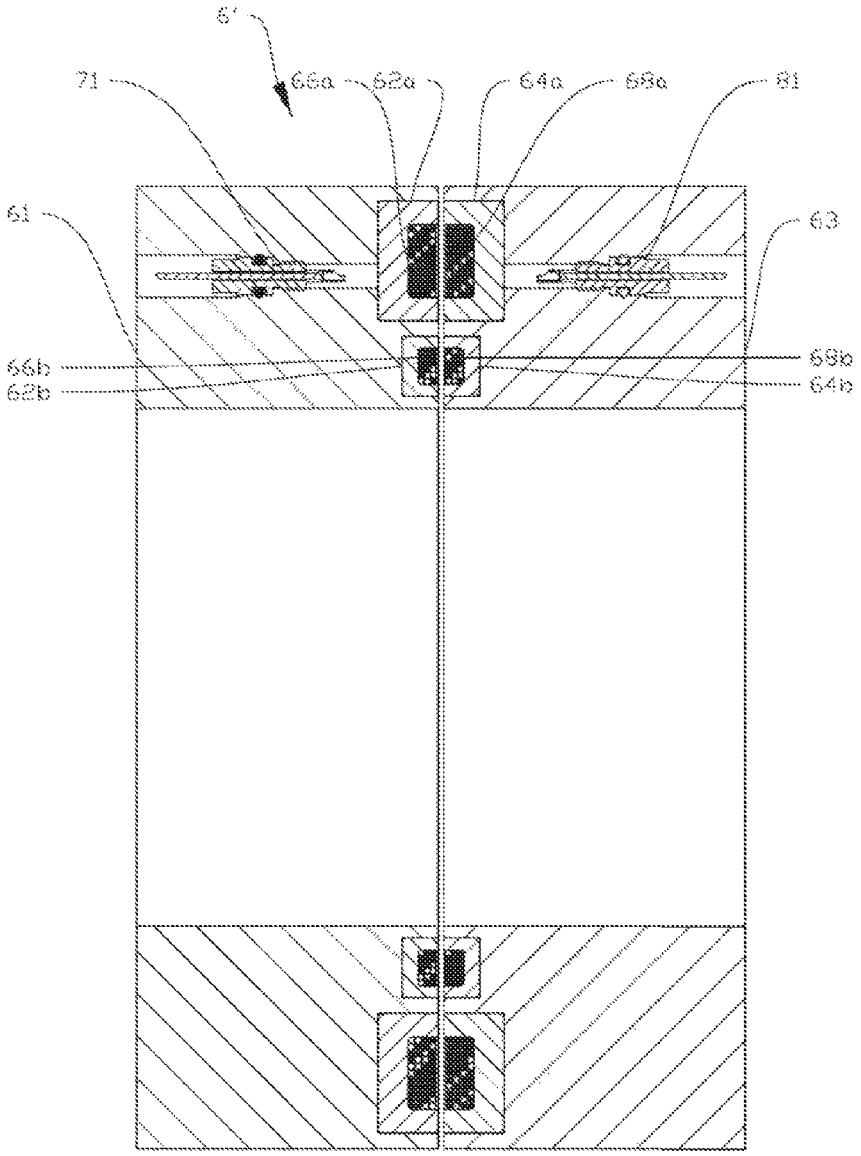
FIG. 4 shows, in an enlarged view, an alternative embodiment of the detail from FIG. 3.

In the following is described an example of a preferred non-limiting embodiment illustrated in the accompanying drawings, wherein: FIG. 1 shows, in a perspective view, a downhole drilling device according to the present invention; FIG. 2 shows, in a cross-section, the downhole drilling device from FIG. 1; FIG. 3 shows, in an enlarged view, a detail from FIG. 2; and FIG. 4 shows, in an enlarged view, an alternative embodiment of the detail from FIG. 3. In the following, identical reference numeral will represent identical or similar features in the figures, which are shown simplified and schematic.

The reference numeral 1 indicates a downhole drilling device according to the present invention. The downhole drilling device 1 will typically be a part of a bottom hole assembly constituting the lower portion of an otherwise not shown drill string. The downhole drilling device 1 is, at its lower end, adapted to be connected to a not shown drill bit as will be known to a person skilled in the art.

FIG. 1 shows the downhole drilling device 1 according the present invention in a perspective view. The upper portion of the downhole drilling device 1 is connectable to the remaining portion of a not shown drilling string. A rotating bit shaft 2, connectable to a drill bit, is visible at the lower end of the downhole drilling device 1. Above the rotating bit shaft 2 is located a non-rotating, radially displaceable guiding device 4 comprising a near bit stabilizer 41 and operable as will be shown and described in detail with reference to FIG. 2. The upper part of the downhole drilling device 1 comprises a rotating stabilizer sub 9 and a rotating stabilizer 91. The rotating stabilizer 9 sub, including the rotating stabilizer 91, is rotatable together with the rotating bit shaft 2 and the rest of the not shown drill string. Stabilizers, including rotating stabilizers, are well known to a person skilled in the art and will not be discussed more in detail herein. Between the rotating stabilizer 91 and the near bit stabilizer 41, the downhole drilling device 1 is provided with a non-rotating housing 13.

FIG. 2 shows a cross-section of the downhole drilling device 1 shown in FIG. 1. The downhole drilling device 1 is formed with a central bore 21 for the circulation of drilling mud therethrough. In the central bore 21, at the upper end of the downhole drilling device 1, surrounded by the rotating stabilizer sub 9 is located a power source 5 in the form of a mud turbine generator. The mud turbine generator 5, which is rotating together with the stabilizer sub 9, is generating electrical power from the mud flowing through the bore 21 and feeds the power to an inductive coupler 6, so as to wirelessly transfer power between a rotating and a non-rotating part of the downhole drilling device 1 as will be explained in the following. The inductive coupler 6 comprises a primary side 61 and a secondary side 63. In the shown embodiment the primary side 61 is rotating, whereas the secondary side 63 is non-rotating. The power from the mud turbine generator 5 is fed to an electronics module 7 on the primary side 61. The electronics module 7, which is only shown schematically, may be provided in a variety of embodiments, all of which may solve the underlying technical problem of transferring power across a rotating gap in the downhole drilling device 1 in an efficient and reliable way without departing from the scope of the invention. The electronics module 7 on the primary side 61 will therefore not be described in detail here, but reference is made to the general part of the description for information about different configurations. Typical parts which may be a part of the electronics module is a three-phase rectifier, a power inverter, a main control unit and various control electronics, including electronics for driving the primary side 61 of the inductive coupler 6. Two embodiments of the inductive coupler 6 itself are shown and discussed with reference to FIGS. 3 and 4 below. The secondary side 63 is non-rotatably supported by the primary side 61 via a bearing unit 22. The person skilled in the art will also understand the in alternative embodiments, the secondary side 63 of inductive coupler 6 may be rotating and that the primary side 61 may be non-rotating. On the secondary side 63 of the inductive coupler a second electronics module 8 is located. The second electronics module will typically comprise electronics for controlling the secondary side 63 of the inductive coupler 6, a one-phase rectifier and drivers for various components connected to the secondary side as will be mentioned in the following. A first actuator 42 in the form a first motor is connected to and powered from the secondary side 63 of the inductive coupler 6. The first motor 42 is further connected to a first eccentric sleeve 48, via a first gear box 44 and a first shaft 46. A second actuator 43, in the form of a second motor, is also connected to and powered from the secondary side 63 of the inductive coupler 6. The second motor 43 is further connected to a second eccentric sleeve 49, via a second gear box 45 and a second shaft 47. The two motors 42, 43 control the amount and direction of radial displacement of the non-rotating stabilizer 41 by rotating the eccentric sleeves 48, 49. This functionality was previously described in WO 2008156375 and WO 2012152914, and reference is made to these publications for an in-depth explanation of this functionality. The non-rotating stabilizer 41 may thus be used to push the not shown drill bit in a well to control the direction of drilling. A person skilled in the art will understand, after having read the present description, that the power available on the secondary side 63 of the inductive coupler 6 may be used to power any electrical actuator for various operations that are not described in the referenced publications.

FIG. 3 shows an enlarged view of the inductive coupler 6 from FIG. 2. The inductive coupler 6 is shown in a radial arrangement with relative rotating parts arranged in a radial arrangement. In the shown cross-section a first U-shaped magnetic means 62*a*, in the form of a ferrite core, on the primary side 61 is surrounded by windings 66*a* and arranged adjacent a first U-shaped magnetic means 64*a* on the secondary side 63 and surrounded by windings 68*a*. The radial gap between the first magnetic means 62*a*, 64*a* should be less than 1 millimeter and preferably less than 0.5 millimeters as discussed in the general part of the description. This first set of windings 66*a*, 68*a* is adapted to transfer power from the primary side 61 to the secondary side 63. A second, smaller U-shaped magnetic means 62*b* on the primary side 63 is surrounded by windings 66*b* and arranged adjacent a second, smaller U-shaped magnetic means 64*b* on the secondary side 63 surrounded by windings 68*b*. The second set of windings 66*b*, 68*b* are adapted to transfer data between the first and secondary sides 61, 63 of the inductive coupler 6. If the data transfer frequency is much higher than the power transfer frequency, for example 2 MHz or higher, it may use the principles of radio transmission, in this case the smaller U-shaped core may be of a non-conductive material such as polyether ether ketone (PEEK).

FIG. 4 shows an inductive coupler 6' with the relative rotating parts arranged axially relative to each other. As with the radial arrangement the inductive coupler 6' comprises windings 66*a*, 68*a* surrounding magnetic means 62*a*, 64*a* for power transfer from the primary side 61 to the secondary side 63 and windings 66*b*, 68*b* surrounding magnetic means 62*b*, 64*b* for data transfer between the primary and secondary sides 61, 63. In the cross-sectional view of FIG. 4 also electrical connectors 71 and 81 are shown for connecting the inductive coupler 6 to the mentioned electronic units 7 and 8 on the primary side 61 and secondary side 63 respectively.

The invention claimed is:

1. A downhole drilling device (1) comprising:

a rotating bit shaft (2) rotatable via a drill string (11);

a guiding device (4) provided between said rotating bit shaft (2) and said drill string (11), said guiding device (4) being connected to and operable independently from said drill string (11), the guiding device (4) being a tubular nonrotating near bit stabilizer (41), the non-rotating near bit stabilizer (41) being radially displaceable from said drill string (11); and a power source (5) for powering said guiding device (4), characterized in that the downhole drilling device (1) further includes:

an inductive coupler (6, 6') having a primary side (61) and a secondary side (63), said inductive coupler (6, 6') being adapted to transfer power from said power source (5), connected to the primary side (61) of said inductive coupler (6, 6'), to said guiding device (4), connected to the secondary side (63) of said inductive coupler (6, 6').

2. The downhole drilling device (1) according to claim 1, wherein the power source (5) is a downhole power source.

3. The downhole drilling device (1) according to claim 2, wherein the power source (5) is a mud turbine generator.

4. The downhole drilling device (1) according to claim 1, wherein the power source (5) is a remote power system.

5. The downhole drilling device (1) of claim 1, wherein the downhole power source (5) is connected to the primary side (61) of said inductive coupler (6, 6') via a rectifier and a power inverter.

6. The downhole drilling device (1) of claim 1, wherein the power source (5) is an alternating current power source directly connected to the primary side (61) of said inductive coupler (5).

7. The downhole drilling device (1) of claim 1, wherein said guiding device includes:

a first electric actuator (42) for controlling the radial displacement of said guiding device (4) relative to said drill string (11); and a second electric actuator (43) for controlling the direction of a radial displacement of said guiding device (4) relative to said drill string.

8. The downhole drilling device (1) of claim 1, wherein said inductive coupler (6, 6') is further adapted for bi-directional data transfer.

9. The downhole drilling device (1) according to claim 8, wherein one or more coils (66*b*, 68*b*) for bi-directional data transfer are isolated from one or more coils (66*a*, 68*a*) for power transfer.

10. The downhole drilling device (1) according to claim 9, wherein said one or more coils (66*b*, 68*b*) for bi-directional data transfer are provided without magnetic means (62*a*, 64*a*) of coils for power transfer.

11. The downhole drilling device (1) of claim 1, wherein said inductive coupler (6, 6'), on the secondary side (63), includes a feedback transmit coil for coupling a signal proportional to an output voltage in a power coil on the secondary side (63) to the primary side (61).

12. The downhole drilling device (1) of claim 1, wherein said inductive coupler includes (6, 6') magnetic means (62*a*, 62*b*, 64*a*, 64*b*) formed with anomalies for the determination of relative position and speed of the primary and secondary sides (61, 63).

13. The downhole drilling device (1) of claim 1, wherein one or more coils of said inductive coupler include U-shaped magnetic means (62*a*, 62*b*, 64*a*, 64*b*).

14. The downhole drilling device (1) of claim 1, wherein at least a part of said inductive coupler (6, 6') device is potted in a resin-based material.

15. The downhole drilling device (1) of claim 1, wherein a gap between the primary side (61) and the secondary side (63) of said inductive coupler is less 1 millimeter and preferably less than 0.5 millimeters.

16. The downhole drilling device (1) of claim 1, wherein the primary side (61) and the secondary side (63) of said inductive coupler (6) are arranged in a radial configuration.

17. The downhole drilling device (1) of claim 1 wherein the primary side (61) and the secondary side (63) of said inductive coupler (6') are arranged in an axial configuration.

18. The downhole drilling device (1) of claim 1 wherein said guiding device (4) is radially displaceable relative to said drill string (11).

19. A method for transferring power and/or data between two parts of a downhole drilling device comprising:

providing the downhole drilling device, the downhole drilling device including:

a rotating bit shaft (2) rotatable via a drill string (11);

a guiding device (4) provided between said rotating bit shaft (2) and said drill string (11), said guiding device (4) being connected to and operable independently from said drill string (11), the guiding device (4) being a tubular nonrotating near bit stabilizer (41), the nonrotating near bit stabilizer (41) being radially displaceable from said drill string (11); and a power source (5) for powering said guiding device (4), and an inductive coupler (6, 6') having a primary side (61) and a secondary side (63), said inductive coupler (6, 6') being adapted to transfer power from said power source (5), connected to the primary side (61) of said inductive coupler (6, 6'), to said guiding device (4), connected to the secondary side (63) of said inductive coupler (6, 6'); and transmitting, using the inductive coupler, the power and/or data between a rotating part and a non-rotating part of the downhole drilling device.

* * * * *